US005214870A

United States Patent [19]

Cohen

[11] Patent Number: 5,214,870

[45] Date of Patent: Jun. 1, 1993

[54] SIGN AND ASSEMBLY METHOD

[76] Inventor: Seymour Cohen, 2321 Canyon Back Rd., Los Angeles, Calif. 90049

[21] Appl. No.: 816,322

[22] Filed: Dec. 30, 1991

[51] Int. Cl.[5] ..... G09F 13/06

[52] U.S. Cl. ..... 40/575; 40/580; 40/595

[58] Field of Search ..... 40/575, 576, 594, 595, 40/546, 579, 580, 443; 156/308.8

[56] References Cited

U.S. PATENT DOCUMENTS

| | | | |
|---|---|---|---|
| 1,464,228 | 12/1921 | Van Bloem . | |
| 1,857,882 | 8/1930 | Shipman . | |
| 1,888,584 | 11/1932 | Codieux | 40/580 |
| 2,622,356 | 12/1952 | Valente | 40/575 |
| 2,689,422 | 9/1954 | Hoff . | |
| 2,707,346 | 9/1952 | Fuller . | |
| 2,939,235 | 6/1960 | Wamser . | |
| 4,553,345 | 11/1985 | Bercier et al. . | |
| 4,559,732 | 12/1985 | Levy et al. | 40/595 |
| 4,891,896 | 1/1990 | Boren . | |

FOREIGN PATENT DOCUMENTS

| | | | |
|---|---|---|---|
| 337073 | 11/1903 | France . | |
| 1558538 | 2/1969 | France | 40/594 |
| 372489 | 3/1931 | United Kingdom . | |

*Primary Examiner*—James R. Brittain
*Assistant Examiner*—Cassandra L. Hope
*Attorney, Agent, or Firm*—Arthur Frelich; Robert Hornbaker; Leon D. Rosen

[57] ABSTRACT

An illuminated sign assembly is provided, of the type that includes illuminated alphanumeric characters lying on a dark background, wherein the characters and/or color can be readily changed at low cost. The sign includes a thick rigid structural plate (26, FIG. 3) of colorless translucent material which can be readily placed in a lightbox that shines light through the plate. A thin color sheet (30) which passes light of a selected color, lies on the front face of the translucent plate, and an opaque character sheet (34) which has apertures (20) defining alphanumeric characters, lies on the front face of the color sheet. The color and character sheets are each thin, so new color and character sheets can be provided at low cost for mounting on the plate. The color and character sheets each have a layer of water-soluble adhesive so a water spray (62, FIG. 11) can be applied to greatly reduce the adhesive viscosity to enable squeegeeing (at Z) of each sheet to remove air bubbles. Characters are cut from the front face of the character sheet (34, FIG. 7) while a backing (72) lies over an adhesive layer on the back face of the character sheet. After character areas are removed, a holder sheet (76) is adhered to the front face of the character sheet, and the backing sheet is then removed. After the character sheet is applied facewise on the color sheet, the holder sheet (76) is removed.

4 Claims, 2 Drawing Sheets

SIGN AND ASSEMBLY METHOD

BACKGROUND OF THE INVENTION

High quality back-illuminated sign assemblies are widely used on theater marquees and entrances for first run motion pictures, and in other applications where a sign is required that is especially attractive in the evening. When used at first run motion picture theaters, such signs may be changed every few weeks. The sign maker may receive only short notice from the motion picture distributor that several hundred or several thousand signs of the rear illuminated type are required for advertising a new motion picture. If the sign that fits in a lightbox has to be completely discarded after each use, then the cost of the signs may be high and only a thin and "flimsy" sign may be provided. If thin material is used to minimize cost, then the outdoor signs may not withstand large gusts of wind. A sign and construction therefor method which enabled the rapid and low cost changing of the display of back illuminated signs, would be of considerable value.

SUMMARY OF THE INVENTION

In accordance with one embodiment of the present invention, a back-illuminated sign is provided which enables the advertisement displayed by the sign to be changed rapidly and at low cost. The sign includes a light-transmitting rigid structural plate which can readily fit into and be removed from a lightbox that can illuminate the rear of the place. A color sheet which passes only light of a selected color is adhered to the front face of the structural plate. An opaque character sheet which has a plurality of apertures defining alphanumeric characters, is adhered to the front face of the color sheet. The color and opaque sheets each have a thickness less than ten per cent that of the thickness of the structural plate, and the color sheet is readily removable from the plate to enable changing of the color and character sheets. Water-soluble adhesive adheres the color sheet to the plate and the character sheet to the color sheet, to facilitate the mounting of thin flexible sheets facewise against each other and the plate with minimal air bubbles.

The sign is constructed by removing a backing from the back of the color sheet, spraying a fine mist against the front of the plate and against adhesive on the back of the color sheet, pressing the color sheet against the plate, and squeegeeing the color sheet on the plate to remove air bubbles. The water spray temporarily minimizes the viscosity of the water-soluble adhesive to enable effective squeegeeing. The character sheet is similarly applied to the front face of the color sheet, but must be first specially prepared. While the character sheet lies on a backing, areas are cut out of the character sheet to leave alphanumeric characters (and also possibly a space for a photographic image). Then a holder sheet is adhered to the front face of the character sheet to hold all cutouts in place while the backing is removed from the character sheet. A water mist is sprayed against adhesive on the back of the character sheet, the character sheet is adhered and squeegeed onto the color sheet, and then the holder sheet is removed.

The novel features of the invention are set forth with particularity in the appended claims. The invention will be best understood from the following description when read in conjunction with the accompanying drawings.

DESCRIPTION OF THE PREFERRED EMBODIMENT

Figure 1:
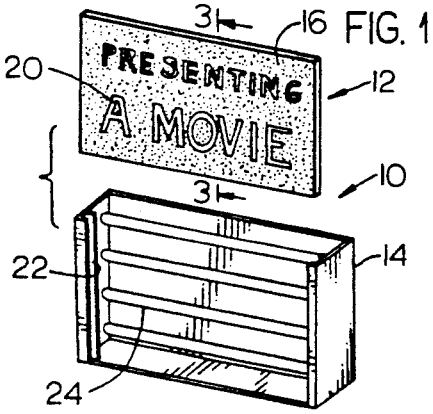
FIG. 1 is an exploded isometric view of a sign assembly.

FIG. 1 illustrates a sign assembly 10 which includes a sign 12 and a lightbox 14 that holds and illuminates the sign. The sign 12 is basically in the form of a plate, with most of the front surface 16 being opaque, but with apertures 20 that allow light to shine therethrough and that usually define alphanumeric characters (but may include photo transparencies or the like). The lightbox has a support 22 that closely receives the sign 12 to securely hold it in place, and also includes a light source 24 that is generally in the form of fluorescent lamps. The light source back-illuminates the sign 12 to allow light to pass through the apertures and permit the sign to be readily viewed in the evening. A "lightbox" is herein defined as any structure that holds a sign and provides light to shine therethrough.

Figure 2:
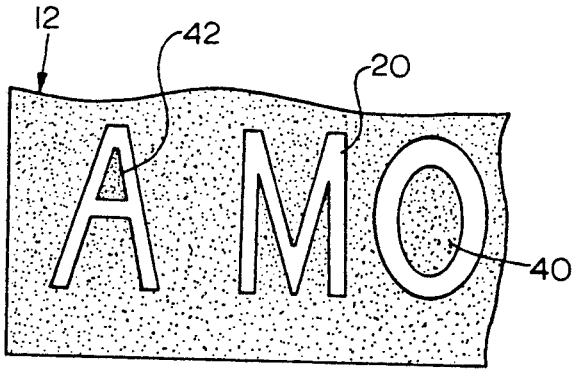
FIG. 2 is a front elevation view of a portion of the sign of the sign assembly of FIG. 1.
Figure 3:
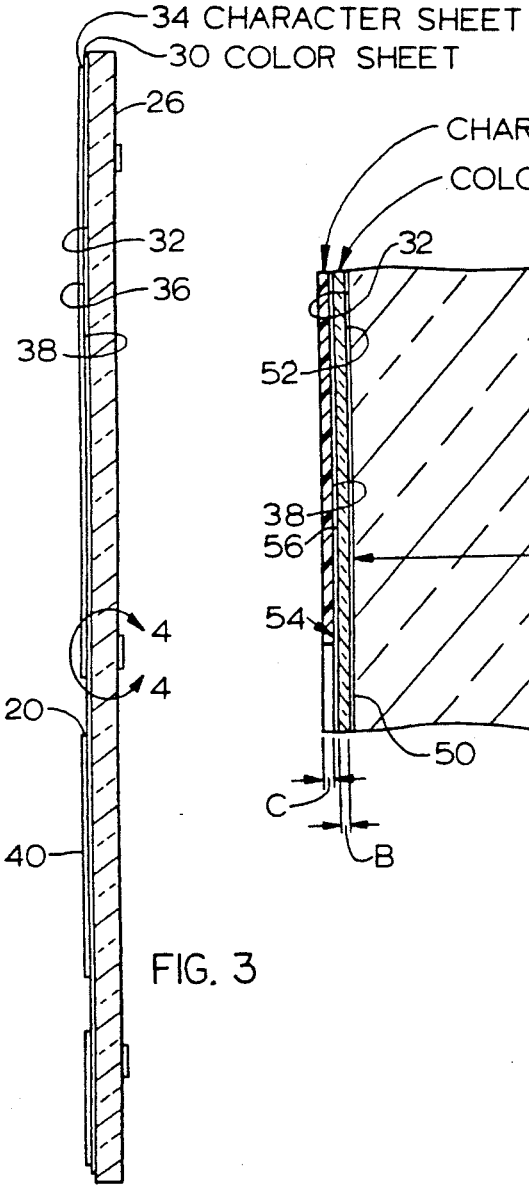
FIG. 3 is a sectional side view of the sign of the sign assembly of FIG. 1.

FIG. 3 illustrates some details of the sign, showing that it includes a thick and rigid light-transmitting structural plate 26 that is translucent. A thin flexible color sheet 30 lies on the front face 32 of the plate, and a thin flexible character sheet 34 lies on the front face 36 of the color sheet. The color sheet 30 allows the transmission of light of only a selected color such as yellow. It should be understood that a selected color may include light of a plurality of different wave lengths or bands (e.g. orange includes yellow and red). The character sheet 34 is opaque, and is generally black, to avoid distracting from light emanating through the apertures 20. The entire rear face 38 of the opaque sheet must be firmly attached to the front face of the color sheet, especially because many characters include "cutout" portions such as the portion 40 representing the middle of an "O". FIG. 2 shows that a portion of the large letters of the sign 12 include the cutout 40 representing the center of the "O" and another cutout 42 representing part of an "A", with both cutouts being completely separated from the rest of the character sheet.

Figure 4:
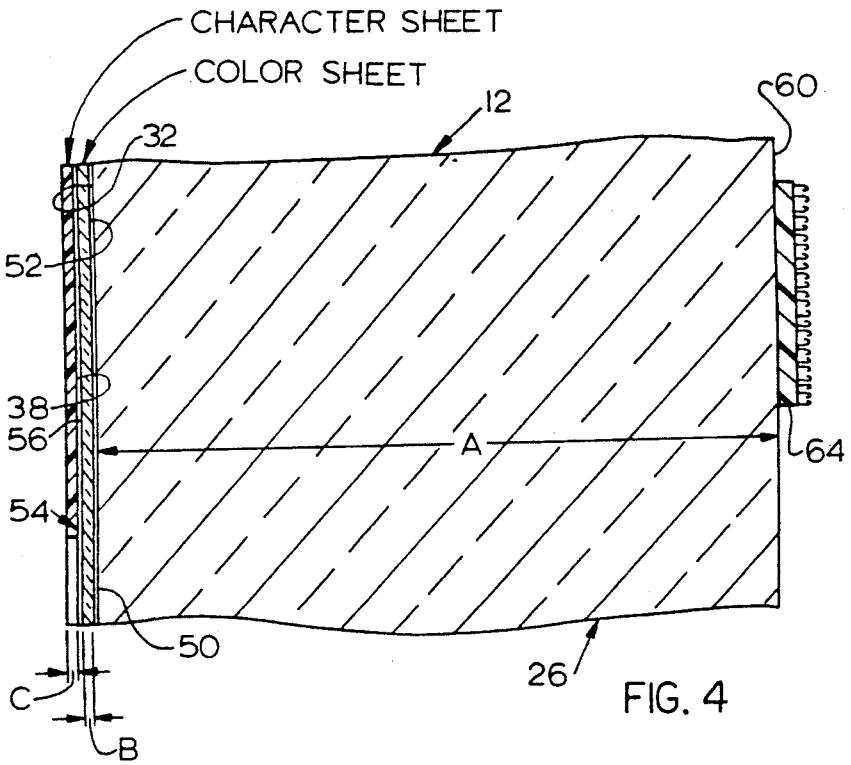
FIG. 4 is an enlarged view of the area 4—4 of FIG. 3, with the thicknesses of the structural plate and of the color sheet and opaque sheet being shown to scale.

FIG. 4 shows details of the sign 12, showing a first layer of water-soluble adhesive 50 holding the rear face 52 of the color sheet to the front face 32 of the structural plate 26, and also showing a second layer 54 of water soluble adhesive which adheres the rear face 38 of the character sheet 34 to the front face 56 of the color sheet. In the particular sign shown in FIG. 4, the plate 26 has a thickness A of about one quarter inch (0.250 inch) and is constructed of acrylic plastic with a roughened rear surface 60 to aid diffusion. The color sheet 30 is constructed of flexible vinyl plastic having a thickness B of 0.004 inch, or 4 mils (one mil equals one thousandth inch). The character sheet 34 is formed of opaque black flexible vinyl plastic which has a thickness C of 4 mils. Such thin vinyl sheets are flexible and readily available at low cost, and are also readily available with a water soluble contact adhesive on one surface which is covered by a paper backing.

Figures 5, 6, 7, 8, 9, 10:
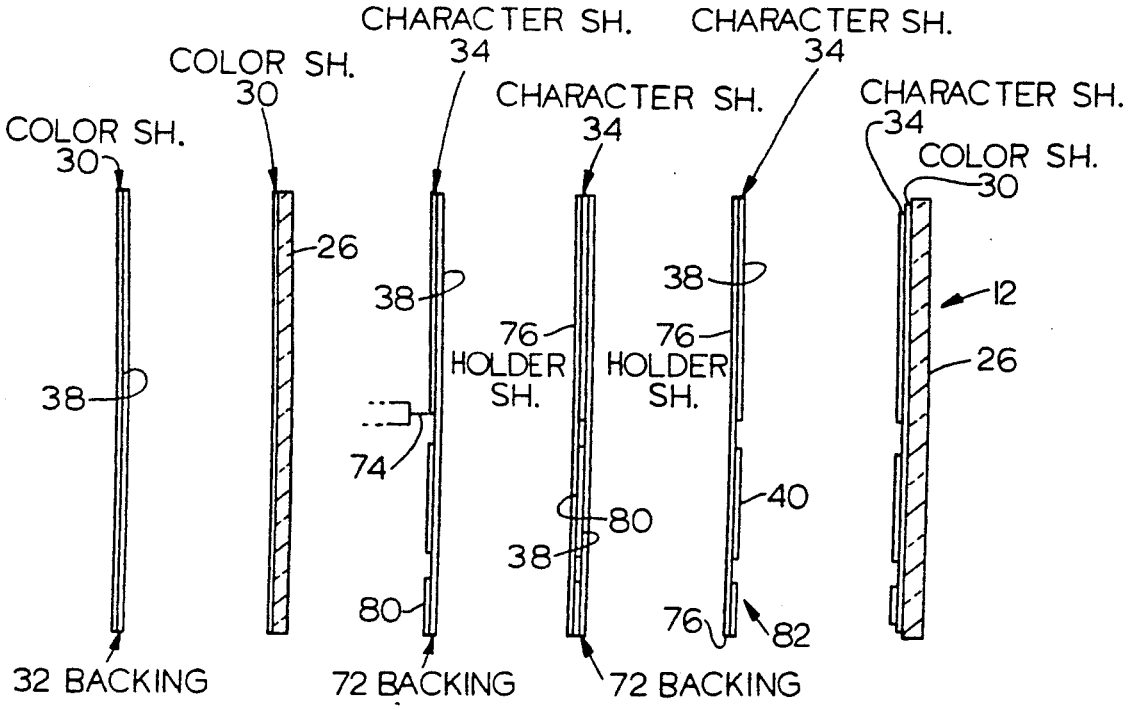
FIG. 5 is a sectional side view of the color sheet shown in FIG. 3 but with a backing thereon.
FIG. 6 is a sectional view of the color sheet of FIG. 3 after the backing has been removed and the color sheet has been applied to the structural plate, to form an assembly similar to that of FIG. 3, but without the character sheet in place.
FIG. 7 is a sectional view of the character sheet of FIG. 4, shown lying on a backing, and indicating the manner in which areas of the character sheet are removed to represent alphanumeric characters.
FIG. 8 is a sectional view of the character sheet of FIG. 7, shown after apertures have been formed therein and a holder sheet has been applied.
FIG. 9 is a view similar to that of FIG. 8, but after the backing has been removed.
FIG. 10 is a view of the assembly of FIG. 6, but after the character sheet and holder of FIG. 9 have been applied and the holder has been removed.
Figure 11:
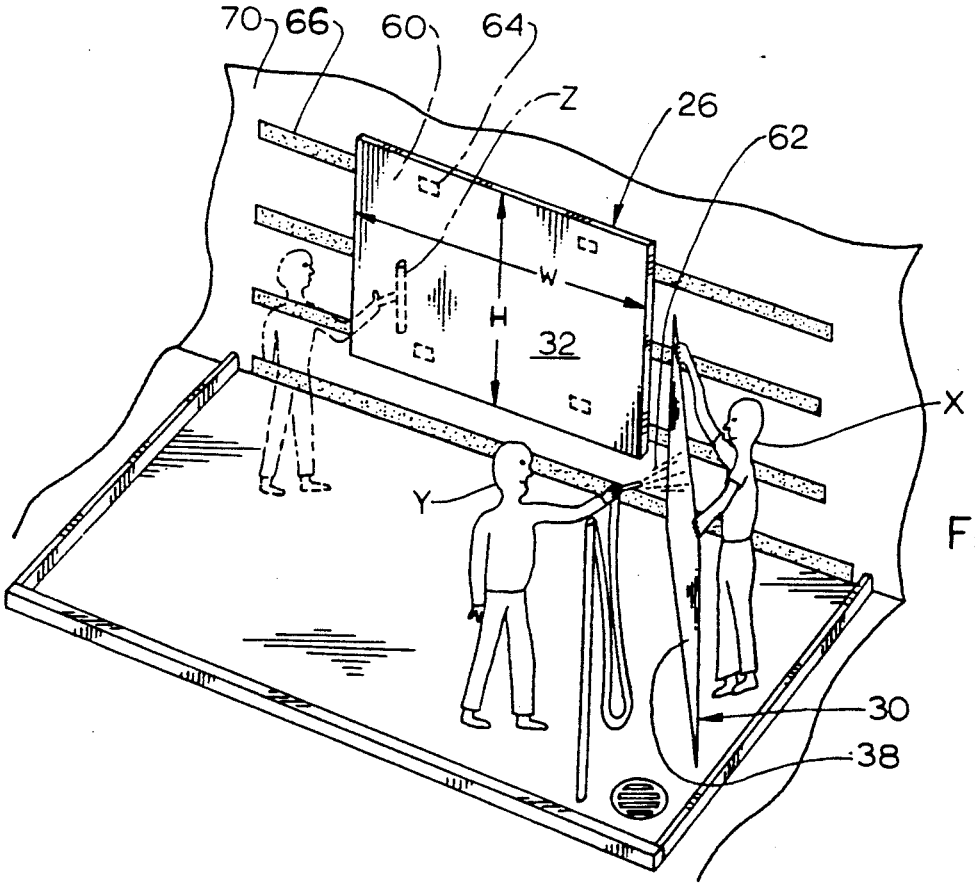
FIG. 11 is an isometric view of a sign construction station, indicating the manner in which some of the steps shown in FIGS. 5–10 are performed.

FIGS. 5–10 illustrate steps in the construction of the sign 12. FIG. 5 shows the color sheet 30 with a paper backing sheet or backing 32 thereon which covers a water soluble adhesive (shown at 54 in FIG. 4) on the rear face 38 of the color sheet. FIG. 6 shows the color sheet 30 after the backing has been removed and the adhesive has been attached to the structural plate 26. FIG. 11 shows a method which is used to apply the color sheet to the plate 26. Applicant first applies a very fine spray 62 uniformly to the rear face 38 of the color sheet 30 to reduce the viscosity of the water-soluble adhesive thereon. FIG. 11 shows one workman X holding up the color sheet, while another workman Y applies the fine spray to the sheet. The spray is in the form of a mist, and a uniform mist can be applied by the worker while moving the spray nozzle back and forth across the color sheet in a raster pattern. The worker Y also preferably applies the same spray to the front face 32 of the rigid plate 26. The workers X and Y then press the rear face 38 of the color sheet, with the water-sprayed adhesive thereon, against the front face 32 of the plate 26. Where a larger sign is to be constructed, two workmen hold up the color sheet during spraying. The rear surface 60 of the rigid plate 26 has many Velcro pads 64 that enable it to be detachably held to corresponding Velcro strips 66 attached to a wall 70 of a sign construction facility.

The workmen X, Y attempt to place the color sheet accurately on the structural plate 26, and without air bubbles between them. However, some adjustment in the position of the color sheet 30 is required, and air bubbles almost always have to be removed. The low viscosity of the water-sprayed adhesive layer enables a workman such as X to press against the front face of the applied color sheet with a vertical or sideward component to slightly shift the color sheet. The workman X also uses a squeegee as indicated at Z to squeegee the front surface of the color sheet to remove air bubbles by pushing the air bubbles out to an edge of the color sheet. The low viscosity of the misted adhesive also aids in removal of air bubbles. After the color sheet has been applied, the character sheet must be applied.

FIG. 7 shows the character sheet 34 whose rear face 38 and the adhesive layer thereon is covered by a backing 72. With the backing 72 in place, the character sheet-34 is laid on a table and several locations along the edge of the sheet are pulled apart to maintain the sheet in tension. Then, a computer controlled cutter 74 in the form of a knife, cuts into the character sheet 34, and usually slightly into the backing 72, to form a cut around all of the apertures. After all of the apertures in the character sheet have been cut, a workman can peel off the portions of the character sheet which lie in the aperture.

FIG. 8 shows a next step, where a holder sheet 76 is applied to the front face 80 of the character sheet. The holder sheet 76 has adhesive similar to that of masking tape, which will allow the holder sheet to be readily peeled off of the front face of the character sheet. With the holder sheet 76 attached to the front face 80 of the character sheet, the backing 72 is removed from the rear face 38 of the character sheet, as by peeling off the backing.

FIG. 9 shows an arrangement 82 which includes the character sheet 34 with cutouts such as 40 thereof held in place with respect to the rest of the character sheet solely by the holder sheet 76. The character sheet arrangement 82 is treated in the same manner as the color sheet 30 of FIG. 11. That is, while one workman X holds up the arrangement 82 that includes the character sheet and holder sheet, the other workman Y applies a fine spray or mist 62 to the adhesive layer on the rear face of the character sheet, and also applies the spray or mist to the front face of the color sheet. The workman X then presses the character sheet arrangement against the front face of the color sheet. The low viscosity of the misted adhesive allows the character sheet arrangement to be shifted in position to be aligned with the color sheet, and also facilitates squeegeeing of the character sheet arrangement to remove air bubbles. Squeegeeing is accomplished by applying a squeegee to the front face of the holder sheet 76. After the character sheet arrangement has been squeegeed, the holder sheet 76 is removed. Removal is accomplished by peeling, by separating a corner of the holder sheet 76 from the character sheet and gently pulling the holder sheet while holding the character sheet in position. Special care is taken at each cutout. As shown in FIG. 10, the result of the operation is the sign 12 which includes the color sheet 30 sandwiched between the structural plate 26 and the character sheet 34.

The sign 12 may be used for several weeks at a first run motion picture theater, and then is no longer needed. Applicant constructs a new sign by peeling off the color sheet 30 from the structural plate 26, the character sheet comping off with the color sheet. The flexible vinyl plastic color sheet is cohesive, in that is holds together even when not mounted which enables rapid initial mounting and rapid peeling off. The structural plate 26 is then reused in constructing a new sign. The structural plate 26 has a thickness that is at least five times and preferably at least ten times the thickness of each of the color and character sheets 30, 34. As a result, the structural plate 26 is fairly expensive, while the flexible vinyl sheets 30, 32 are relatively inexpensive. The reuse of only the expensive part of each sign minimizes cost and the required inventory of structural plates. The vinyl sheets are available in rolls and are easily stored. It should be noted that for larger signs that require thicker structural plates for rigidity (especially against the wind), applicant prefers to use a "waffle" plate, wherein the structural plate is formed of a thin front plate part, and a honeycomb-like structure behind it. The honeycomb structure minimizes the cost and weight of the plate, while assuring high rigidity. Such a waffle plate can be used even for relatively thin (e.g. one-quarter inch) thick structural plates. The sign construction shown is especially useful for at least moderately large signs such as those of at least about fifteen square feet area (e.g. a five foot by three foot sign) where it is difficult to apply a color or character sheet without creating noticeable air bubbles. It should be noted that in some signs, different areas of the sign are to be of a different color, and in that case two or more different color sheets of different colors can be applied side-by-side to the structural plate.

Thus, the invention provides a back illuminated sign which can be readily constructed at low cost. The sign includes a light-transmitting, and preferably translucent, clear structural plate, a color sheet adhered to the front face of the structural plate, and a character sheet adhered to the front face of the color sheet. The structural plate is rigid and has a much greater thickness than the thin and flexible color and character sheets. The color sheet is sandwiched between the plate and character sheet, and is held to each by a water soluble adhesive which can be misted during assembly to facilitate positioning and air bubble removal. The use of water soluble adhesive avoids the need for nonwater solvents to reduce viscosity and avoids the considerable care required in spraying such nonwater solvents. The sign is constructed by applying a fine mist of water to reduce the viscosity of water soluble adhesive on each sheet, and after each sheet is applied it is squeegeed to remove air bubbles. The character sheet is used by cutting out apertures therein while the rear of the aperture sheet is held by a backing, and then applying a holder sheet to the front face of the character sheet, removing the backing from the rear face of the character sheet, applying the water-sprayed adhesive-coated rear face of the character sheet to the color sheet, and then removing the holding sheet.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A sign assembly comprising:

a light-transmitting rigid structural plate;

a lightbox which includes a support that removably support said plate and a light source which shines light at said plate;

a color sheet which passes only light of a selected color;

said color sheet being sandwiched between said plate and said character sheet, with said color sheet having a rear face adhered to said plate and said character sheet having a rear face adhered facewise to said color sheet;

said sheets each have a thickness no more than ten per cent of the thickness of said plate, and said color sheet is removably adhered to said plate to enable changing of the color and character sheets, and said color sheet is flexible and cohesive to thereby enable rapid mounting and peeloff, whereby substantially the selected color of characters is seen when frontlit and when backlit.

2. The sign described in claim 1 wherein:

said plate is substantially colorless, whereby to enable its use with substantially any color of color sheet.

3. The sign described in claim 1 wherein:

said rigid plate has a surface area of at least fifteen square feet and has a thickness of at least about 0.250 inch, and each of said sheets is of cohesive flexible material and has a thickness of no more than 0.010 inch.

4. A sign for installation in a light box, comprising:

a light-transmitting rigid structural sheet which is substantially colorless, said structural sheet having front and rear surfaces;

a color sheet which passes light of a selected color while blocking the passage of other color components of white light, said color sheet having a face lying facewise against a face of said structural sheet;

an opaque character sheet which has a plurality of apertures defining alphanumeric characters, said character sheet lying facewise against said color sheets, whereby substantially the selected color of characters is seen when frontlit and when backlit;

said color and character sheets each having a thickness of no more than about one-tenth the thickness of said structural sheet, so said sheets have little weight to thereby reliably hold to said plate, and at least said color sheet being flexible and cohesive and readily peelable off said structural sheet to enable rapid removal therefrom.

* * * * *